US006046699A

United States Patent [19]

Elliott et al.

[11] Patent Number: 6,046,699

[45] Date of Patent: Apr. 4, 2000

[54] RETRACTABLE ANTENNA

[75] Inventors: Michael Elliott, Poriya Illit; Matti Martiskainen, Tiberias Illit, both of Israel

[73] Assignee: Galtronics Ltd., Tiberias, Israel

[21] Appl. No.: 09/087,567

[22] Filed: May 29, 1998

Related U.S. Application Data

[60] Provisional application No. 60/048,414, Jun. 3, 1997.

[51] Int. Cl.[7] ..... H01Q 1/24

[52] U.S. Cl. ..... 343/702; 343/700 MS

[58] Field of Search ..... 343/700 MS, 702, 343/901; H01Q 1/24

[56] References Cited

U.S. PATENT DOCUMENTS 4,313,119 1/1982 Garay et al. ..... 343/702

5,245,349 9/1993 Harada ..... 343/700 MS 5,438,339 8/1995 Itoh et al. ..... 343/702

5,764,190 6/1998 Murch et al. ..... 343/702

5,905,467 5/1999 Narayanaswamy et al. ..... 343/702

*Primary Examiner*—Don Wong

*Assistant Examiner*—Shih-Chao Chen

*Attorney, Agent, or Firm*—Ladas & Parry

[57] ABSTRACT

A retractable antenna module including a first, generally stationary plate and a second plate, movable relative to the first plate. The second plate moves between a retracted configuration of the module, in which the plates together function substantially as a feedthrough-fed antenna, and an extended configuration of the module, in which the second plate functions substantially as a monopole antenna.

4 Claims, 5 Drawing Sheets

RETRACTABLE ANTENNA

RELATED APPLICATIONS

This application claims the benefit of U.S. Provisional Patent Application 60/048,414, filed Jun. 3, 1997, which is assigned to the assignee of the present patent application and is incorporated herein by reference.

FIELD OF THE INVENTION

The present invention relates generally to microwave antennas, and specifically to antennas for use in cellular communications.

BACKGROUND OF THE INVENTION

Cellular telephones typically include either a retractable, whip-type antenna, or a fixed or retractable helical antenna, or a combination of two or more of these types. In any case, there must generally be some protrusion from the typically rectangular case of the phone in order to attain acceptably high antenna gain and, thus, good quality reception. The protrusion makes the telephone less convenient to carry, for example, in a clothes pocket, and is prone to breakage.

FIG. 1 is a schematic illustration of a type of feedthrough-fed antenna known in the art as an "Inverted-F" antenna 20. The antenna comprises a ground plane 22 and a conducting plate 24, fixed in a generally parallel, mutually-spaced relation to the ground plane. Plate 24 is coupled to ground plane 22 by a ground connection 26 at one end of the plate. A 50 ohm feed-through 28 couples plate 24 to a suitable transmitter and/or receiver circuit (not shown in the figures), as is known in the art.

SUMMARY OF THE INVENTION

It is an object of the present invention to provide a retractable antenna for a cellular telephone, wherein in a retracted position, the antenna is contained substantially entirely within a generally rectangular volume of the telephone.

In preferred embodiments of the present invention, an antenna module for a cellular telephone comprises a retractable, generally planar antenna, having retracted and extended positions. In the retracted position, the antenna is contained substantially entirely within a compact, rectangular volume defined by a housing of the telephone and functions as a feedthrough-fed antenna, preferably as an inverted-F type antenna. In the extended position, the antenna protrudes out of the housing, preferably generally upwards, and functions preferably as a monopole antenna. Preferably, a single feed-through is used to couple the antenna to transmitter/receiver circuitry in the telephone in both the retracted and extended positions.

There is therefore provided, in accordance with a preferred embodiment of the present invention, a retractable antenna module including:

a first, generally stationary plate; and a second plate, movable relative to the first plate between a retracted configuration of the module, in which the plates together function substantially as a feedthrough-fed antenna, and an extended configuration of the module, in which the second plate functions substantially as a monopole antenna.

Preferably, the first plate functions as a ground plane.

Preferably, in the retracted configuration, the antenna functions as an inverted F antenna.

Preferably, in the extended configuration, the antenna functions as a quarter-wave antenna.

Preferably, the antenna module in the retracted configuration is substantially enclosed within a generally rectangular volume of a communication device to which the antenna is coupled.

Additionally, the antenna in the extended configuration protrudes from the rectangular volume.

Preferably, conversion from the retracted configuration to the extended configuration, and vice versa, is accomplished by sliding the second conducting plate.

Preferably, the module includes a matching circuit, which couples the second plate to a transmitter/receiver in the extended configuration.

Additionally, the second plate in the retracted configuration is decoupled from the matching circuit.

Alternatively, the matching circuit is shorted to the ground plane in the retracted configuration, and is decoupled from the ground plane in the extended configuration.

Preferably, the matching circuit includes a transmission line.

Alternatively, the matching circuit is formed of a circuit printed on the ground plane.

Preferably, the module includes a single feedthrough, which couples the antenna to the transmitter/receiver in both the extended and retracted configurations.

There is further provided, in accordance with a preferred embodiment of the present invention, an antenna module for a cellular phone having a housing, the module including:

an antenna, having retracted and extended operational positions, such that in the retracted position, the antenna is contained substantially entirely within a generally rectangular volume defined by the housing.

Preferably, the antenna is generally planar.

Preferably, the antenna in the extended position protrudes from the housing.

Preferably, the module includes a ground plane.

Preferably and additionally, the antenna in the retracted position is coupled to the ground plane.

Preferably and additionally, the antenna in the extended position is decoupled from the ground plane.

Preferably, the module includes a matching circuit printed on the ground plane.

Preferably, the module includes a single feedthrough used to couple the antenna to a transmitter/receiver in both the retracted and extended configurations.

There is further provided, in accordance with a preferred embodiment of the present invention, a method for transmitting and receiving signals to and from a portable communication device, including:

fixing a first plate to the communication device;

slideably attaching a second plate in a retracted position generally parallel to and substantially overlapping with the first plate, so that the first and second plates together form a feedthrough-fed antenna coupled to the communication device; and shifting the second plate away from the first plate to an extended position, so as to form a monopole antenna coupled to the communication device.

Preferably, slideably attaching the second plate includes slideably attaching the second plate to form an inverted F antenna with the first plate.

Preferably, shifting the second plate includes shifting the second plate to form a quarter-wave antenna.

Preferably, slideably attaching the second plate includes configuring the second plate in the retracted position to be substantially enclosed within a generally rectangular volume of the communication device.

Alternatively, shifting the second plate includes configuring the second plate to protrude from the rectangular volume.

Alternatively, shifting the second plate includes coupling the second plate to the communication device by a matching circuit, and slideably attaching the second plate includes decoupling the second plate from the matching circuit.

The present invention will be more fully understood from the following detailed description of the preferred embodiments thereof, taken together with the drawings in which:

DETAILED DESCRIPTION OF PREFERRED EMBODIMENTS

Figure 1:
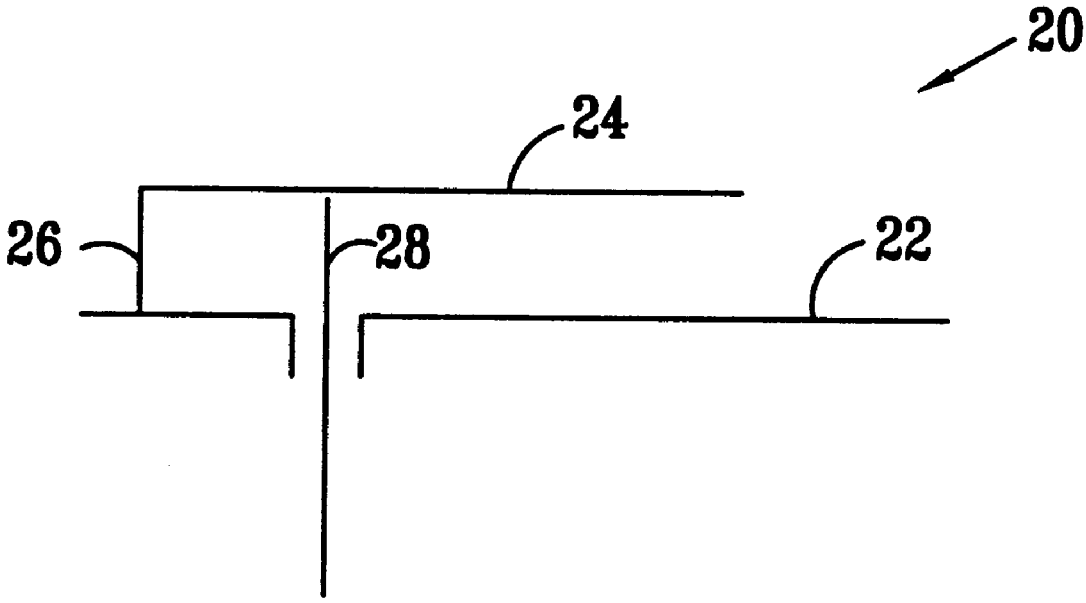
FIG. 1 PRIOR ART
FIG. 1 is a schematic illustration showing a fixed inverted-F antenna, as is known in the art.
Figure 2A:
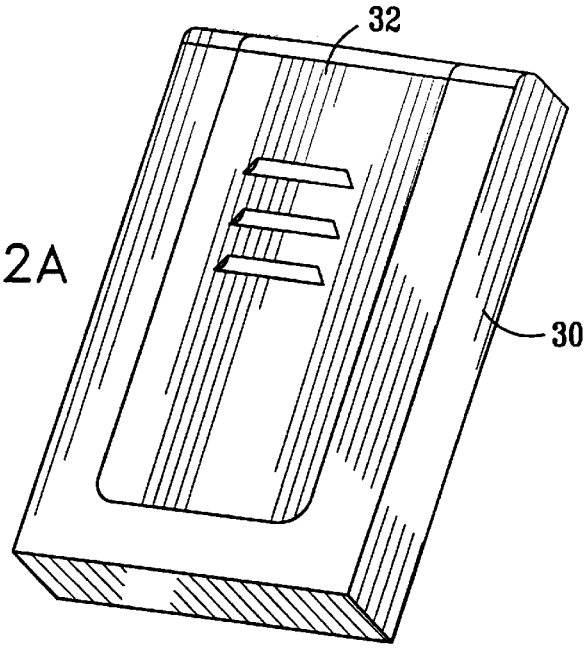
FIGS. 2A and 2B are schematic, pictorial illustrations showing an antenna module for a cellular telephone in retracted and extended positions, respectively, in accordance with a preferred embodiment of the present invention.
Figure 2B:
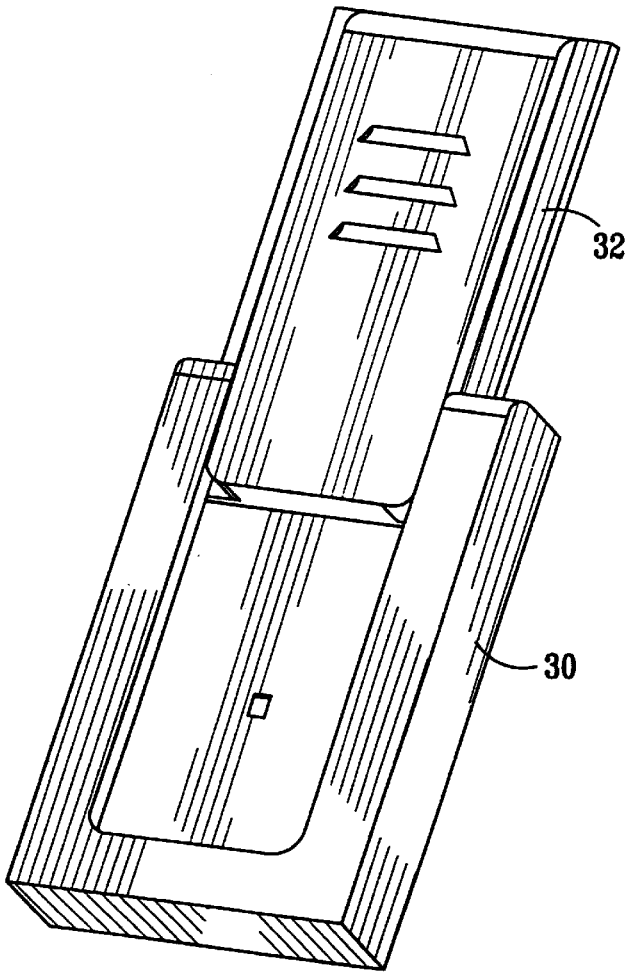
Figure 2C:
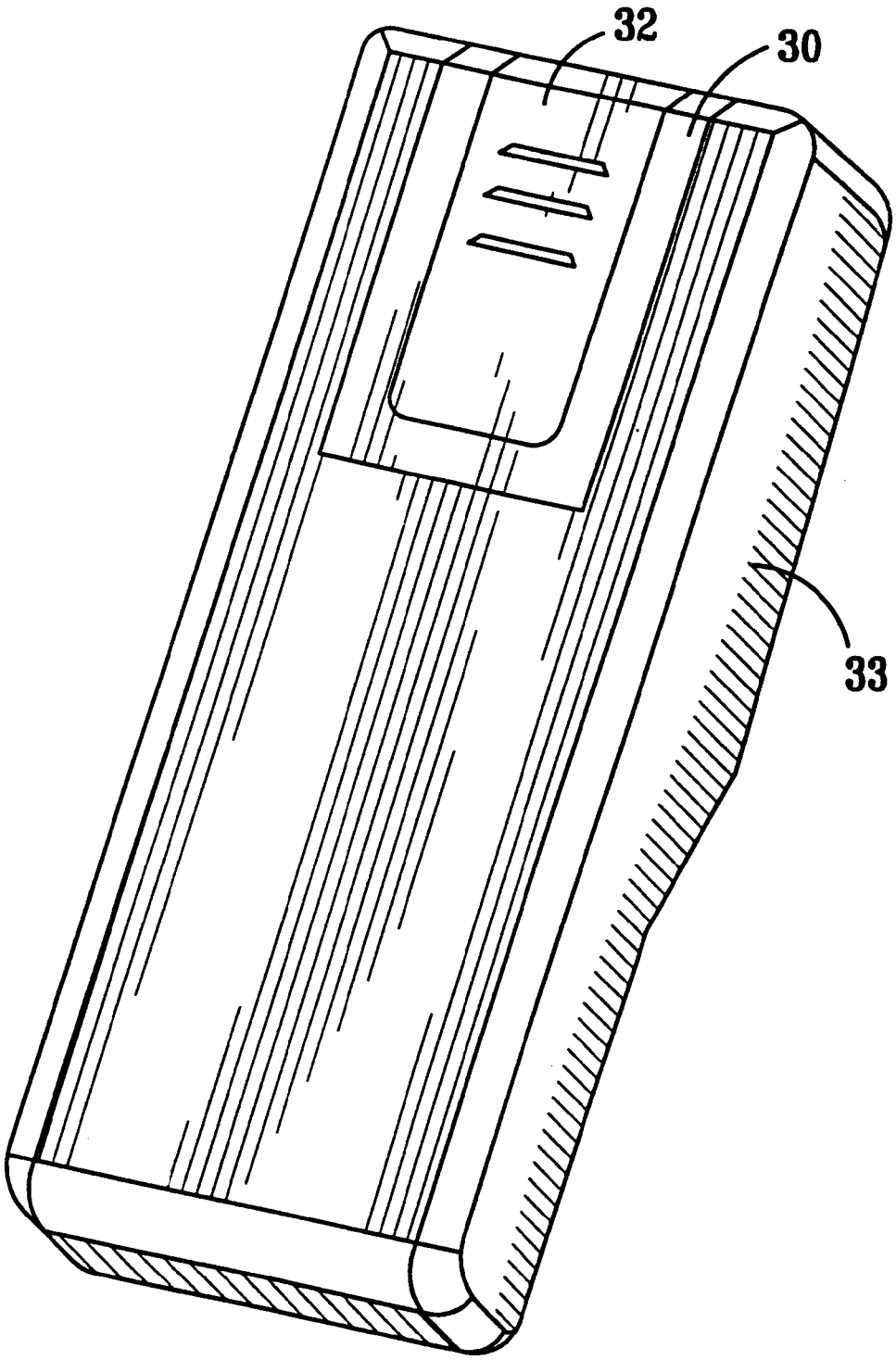
FIG. 2C is a schematic, sectional illustration showing the antenna module of FIG. 2A assembled into a cellular telephone, in accordance with a preferred embodiment of the present invention.

FIGS. 2A and 2B schematically illustrate a cellular telephone antenna module 30, including a retractable antenna 32, in accordance with a preferred embodiment of the present invention. FIG. 2C is a schematic, sectional view of a cellular telephone 33, into which module 30 is assembled. Preferably, as shown in the figures, antenna 32 is substantially flat and generally rectangular. In FIGS. 2A and 2C, antenna 32 is shown in its closed, retracted position, in which it is contained entirely within the generally rectangular volume of module 30 and of telephone 33. Even in this retracted position, however, antenna 32 is active. By contrast, cellular telephone antennas known in the art, both fixed and retractable types, must generally protrude at least partially out of the telephone case in order to attain an acceptable level of reception. In FIG. 2B, antenna 32 is shown in its open, extended position, in which the antenna is preferably pushed up relative to module 30, in order to improve reception during use of the phone.

Figure 3A:
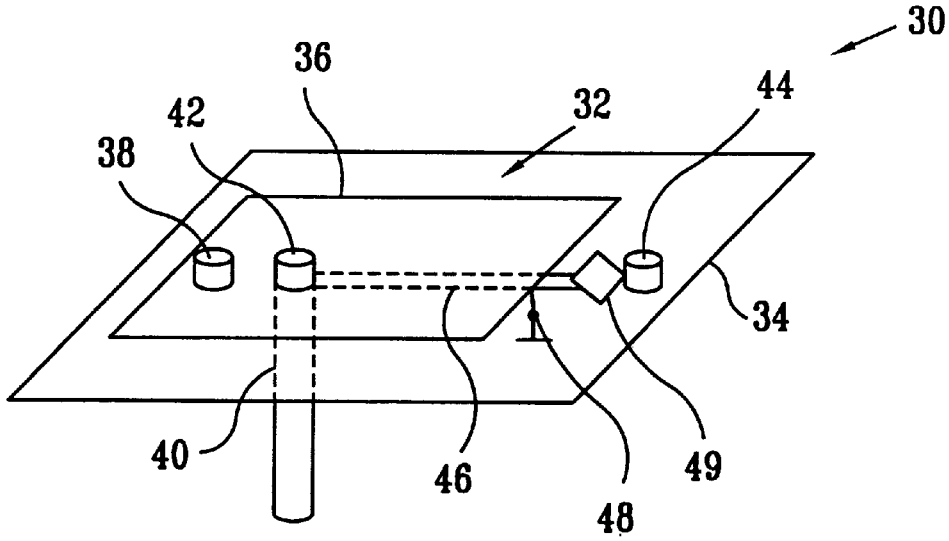
FIGS. 3A and 3B are schematic, pictorial illustrations showing mechanical configurations and connections of the antenna of FIGS. 2A and 2B in the retracted and extended positions, respectively.
Figure 3B:
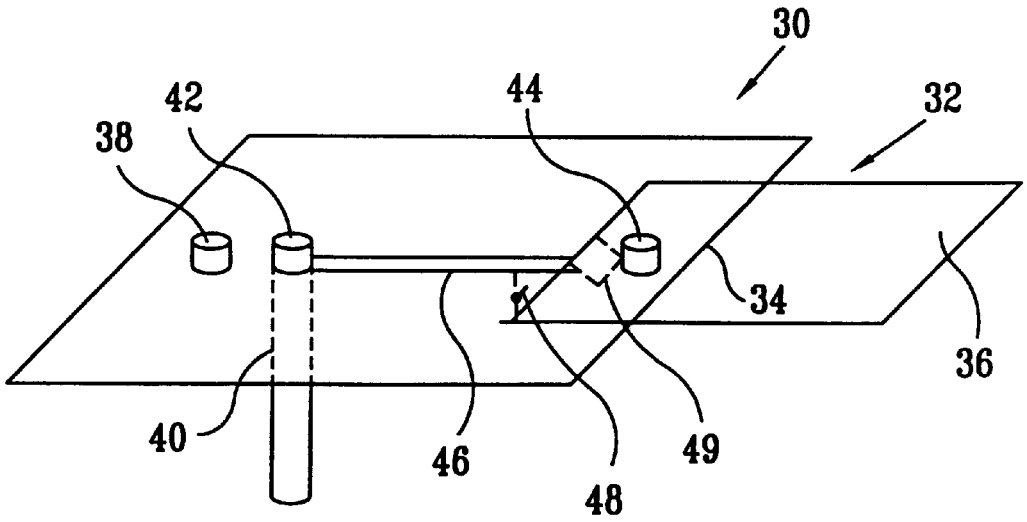
Figure 4A:
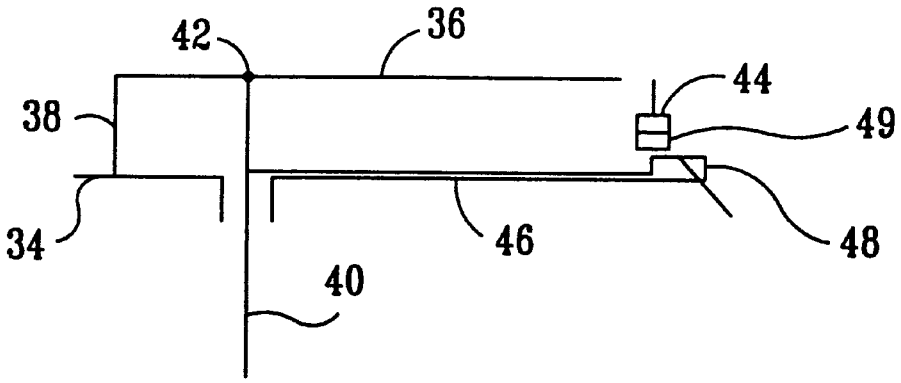
FIGS. 4A and 4B are schematic diagrams showing electrical connections and circuitry associated with the antenna of FIGS. 2A and 2B in the retracted and extended positions, respectively.
Figure 4B:
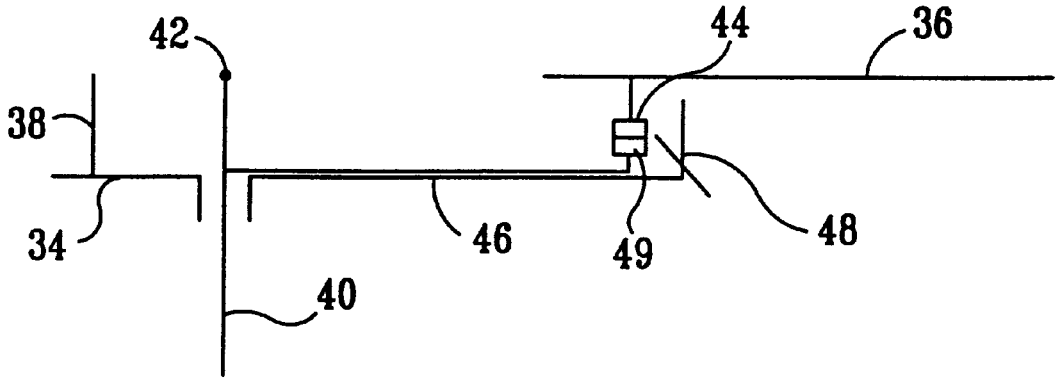

FIGS. 3A and 3B schematically illustrate the inner mechanism of antenna module 30 in the closed and open positions, respectively, in accordance with a preferred embodiment of the present invention. FIGS. 4A and 4B schematically illustrate the electrical configurations of the antenna corresponding, respectively, to the mechanical configurations of FIGS. 3A and 3B.

Antenna module 30 comprises a ground plate 34 and a conducting plate 36 parallel thereto, which functions as an inverted-F type feedthrough-fed antenna in the closed configuration shown in FIGS. 3A and 4A. Plate 36 is grounded to ground plane 34 by a ground contact 38 at one end of the plate. A feed-through line 40, preferably a 50 ohm line, contacts plate 36 at a feed point 42 suitably spaced from ground contact 38, as is known in the art, so as to couple signals from the antenna to transmitter/receiver circuitry (not shown in the figures) in telephone 33.

In the open configuration, shown in FIGS. 3B and 4B, ground contact 38 and feed point 42 are disconnected, and plate 36 functions as a monopole antenna, preferably as a quarter-wave antenna. Plate 36 is coupled to line 40 by means of a matching circuit 49, which may be of any suitable type known in the art, and an alternate feed point 44, in contact with the plate, and a transmission line 46 running along ground plane 34 from feed point 44 to line 40. Preferably, a single contact point on plate 36 contacts feed point 42 in the closed configuration and alternate feed point 44 in the open configuration.

Preferably line 46 comprises a 50 ohm transmission line printed on a surface of the ground plane, for example, using printed circuit technology. In the closed configuration, as shown in FIG. 3A and FIG. 4A, line 46 is preferably grounded by a ground contact switch 48 in a closed position, so that matching circuit 49 is not in use. In the open configuration, as shown in FIG. 3B and FIG. 4B, switch 48 is in an open position, so that matching circuit 49 is in use as described hereinabove. Preferably, switch 48 is mechanically coupled to the movement of plate 36, so as to open and close automatically responsive thereto.

Whereas in the preferred embodiment shown in FIGS. 3A,B and 4A,B, feed-through line 40 is located generally at the lower end of antenna 32, in other preferred embodiments of the present invention, not shown in the figures, line 40 may be in other locations relative to the antenna. For example, line 40 and a feed point corresponding to point 42 in the preceding figures may be positioned near the upper end of antenna 32. In this case, plate 36 may contact the same feed point in both the open and closed configurations, and there may be no need for a transmission line like line 46.

Those skilled in the art will appreciate that the principles of the present invention may be applied to produce compact, retractable antennas of other types, shapes and configurations. For example, plate 36 may be hinged, so as to swing outwards relative to ground plane 34, rather than sliding parallel thereto.

The preferred embodiments described above are cited by way of example, and the full scope of the invention is limited only by the claims.

What is claimed is:

1. A retractable antenna module comprising:

a first, generally stationary plate; and a second plate, movable relative to the first plate between a retracted configuration of the module, in which the plates together function substantially as a feedthrough-fed antenna, and an extended configuration of the module, in which the second plate functions substantially as a monopole antenna, wherein in the retracted configuration, the antenna functions as an inverted F antenna.

2. A retractable antenna module comprising:

a first, generally stationary plate;

a second plate, movable relative to the first plate between a retracted configuration of the module, in which the plates together function substantially as a feedthrough-fed antenna, and an extended configuration of the module, in which the second plate functions substantially as a monopole antenna; and a matching circuit, which couples the second plate to a transmitter/receiver in the extended configuration, wherein the second plate in the retracted configuration is decoupled from the matching circuit.

3. A module according to claim 2, wherein the matching circuit is shorted to the ground plane in the retracted configuration, and is decoupled from the ground plane in the extended configuration.

4. A method for transmitting and receiving signals to and from a portable communication device, comprising:

fixing a first plate to the communication device;

slideably attaching a second plate in a retracted position generally parallel to and substantially overlapping with the first plate, so that the first and second plates together form a feedthrough-fed antenna coupled to the communication device; and shifting the second plate away from the first plate to an extended position, so as to form a monopole antenna coupled to the communication device, wherein slideably attaching the second plate comprises slideably attaching the second plate to form an inverted F antenna with the first plate.

* * * * *